US005980444A

United States Patent [19]

Dickhoff

[11] Patent Number: 5,980,444

[45] Date of Patent: Nov. 9, 1999

[54] APPARATUS AND METHOD FOR Z-FOLDING SHEETS

[75] Inventor: Andreas Dickhoff, Kirchheim-Teck, Germany

[73] Assignee: Eastman Kodak Company, Rochester, N.Y.

[21] Appl. No.: 08/976,769

[22] Filed: Nov. 24, 1997

[30] Foreign Application Priority Data

Dec. 5, 1996 [DE] Germany ..... 196 50 422

[51] Int. Cl.[6] ..... B31F 1/00

[52] U.S. Cl. ..... 493/433; 493/434; 493/435

[58] Field of Search ..... 492/39, 38, 40; 493/434, 435, 442, 444, 445, 454, 458, 254, 243, 258; 53/117, 116, 120

[56] References Cited

U.S. PATENT DOCUMENTS 5,108,082 4/1992 Shea et al. ..... 270/47

5,520,604 5/1996 Reist ..... 493/435

*Primary Examiner*—Peter Vo

*Assistant Examiner*—Matthew Luby

*Attorney, Agent, or Firm*—Lawrence P. Kessler

[57] ABSTRACT

A pivotedly mounted pressure roller unit, associated with which is a folding roller pair, is arranged on the transport path of a sheet to be folded. The pressure roller unit has a first and a second roller group, having rollers offset alternatingly eccentrically with respect to one another and mounted in independently rotatable fashion, which coact with the folding rolls in such a way that simultaneously, the rollers of the first roller group can be laid nonpositively against the one folding roller, and the rollers of the other roller group against the other folding roller. The transport speed ($v_2$) of the folding rolls can be reduced to a lower transport speed ($v_1$), thus causing a transport roller pair driven at an unchanging transport speed to bulge the sheet into an arc prior to entry into the folding rolls. By pivoting the pressure roller unit against the folding rolls, the arc and the trailing end of the sheet are transported simultaneously by the pressure roller unit. Once the folding rolls have grasped the trailing sheet end, the pressure roller unit is pivoted away and the folds in the sheet are made.

10 Claims, 7 Drawing Sheets

APPARATUS AND METHOD FOR Z-FOLDING SHEETS

FIELD OF THE INVENTION

The invention relates to an apparatus and a method for Z-folding sheets, in which a folding roll pair driven in opposite directions and a transport roller pair for delivering the sheets to the folding rolls of the folding roll pair are used.

BACKGROUND OF THE INVENTION

A folding apparatus of the generic type which is arranged in a separate paper path activated, by a diverter, only for purposes of a folding operation is provided in a finisher for sheets disclosed by U.S. Pat. No. 5,108,082. During the folding operation, the transport direction of the sheet being folded must be changed twice in order to be able to produce both folds of the Z-fold. The completed folded product then leaves the folding apparatus in a direction which extends opposite to the transport direction required for continued transport of the folded product. In the case of this known apparatus it is therefore necessary both to divert the completed folded product into the paper path provided for continued transport, and to reverse its transport direction, in order for the folded product to reach a collection or delivery station.

It is the object of the invention to configure a folding apparatus of the generic type in such a way that a sheet being folded can be folded on its transport path without reversal of direction.

SUMMARY OF THE INVENTION

According to the invention, this object is attained in that associated with the folding rolls of the folding roll pair is a pressure roller unit positioned, with respect to the transport path of a sheet, between the transport rollers and the folding rolls which in a first position rests against both folding rolls simultaneously and can be moved into a second position lifted away from the folding rolls. A sensor arranged in the transport path of the sheet is associated with the transport roller pair. A sensor arranged in the transport path of the sheet is associated with the folding rolls. The transport speed of the folding rolls is changeable. The pressure roller unit has a plurality of rollers, arranged next to one another and each independently rotatably mounted. The pressure roller unit has a first and a second roller group with rollers, of which the rollers of the first roller group are mounted eccentrically by a certain amount with respect to the longitudinal axis of the pressure roller unit, and the rollers of the second roller group are mounted eccentrically with respect to the longitudinal axis of the pressure roller unit by the same amount, in the opposite direction from the rollers of the first roller group. The rollers are arranged in such a way that of each two rollers arranged next to one another, one is associated with the first roller group and one with the second; and that with the pressure roller unit in the first position, the rollers of the first roller group are in nonpositive contact against the one folding roll, and the rollers of the second roller group against the other folding roll.

According to the invention, the object underlying the invention is further achieved using a method which includes the following steps. The sheet is transported by the transport roller pair into the roller gap between one of the folding rolls and a pressure roller pair that in a first position rests nonpositively against both folding rolls simultaneously, and from there to the folding rolls, the transport roller pair and the folding rolls transporting at the same transport speed. When the folding rolls have grasped the sheet at a time $t_1$, the pressure roller unit is moved at a time $t_2$, into a second position lifted away from the folding rolls. The sheet is transported by the transport roller pair and the folding rolls until the front end of the sheet reaches a sensor. The sensor generates a signal which, at a time $t_3$, reduces the drive system of the folding rolls to a lower transport speed $v_1$, while the transport speed $v_2$ of the transport rollers is maintained, so that in the region between the folding rolls and the lifted-away pressure roller unit, the sheet is bulged out to form an arc. The rotation speed of the folding rolls is accelerated again to the same transport speed as the transport rollers. The sheet, upon reaching the transport speed $v_2$ of the folding rolls at a time $t_4$, having been bulged out to the required arc length. When a sensor associated with the sheet end is passed by at a time $t_5$, a signal is generated which at a time $t_6$ places the pressure roller unit into the first position nonpositively against the folding rolls. The pressure roller unit, which has a first and a second roller group having rollers offset alternatingly eccentrically with respect to one another and mounted in independently rotatable fashion, is brought into engagement with the folding rolls in such a way that at a time $t_6$, simultaneously, the rollers of the first roller group are nonpositively resting against the one folding roll, and the rollers of the other roller group against the other folding roll, so that the sheet is transported simultaneously by both roller pairs. During simultaneous transport of the sheet by the roller pairs, the two regions of the sheet grasped by the roller groups are folded toward one another, and at a time $t_7$ the first fold is formed between the folding rolls. At a time $t_8$, the pressure roller unit is moved away from the folding rolls into the second, lifted-away position, after which the arc portion of the sheet is folded together and, at a time $t_9$, the second fold is formed between the folding rolls. The completed folded product is delivered by the folding rolls.

The configuration and arrangement according to the invention of the folding apparatus, and the method according to the invention for performing the folding operation by means of said folding apparatus, make it possible, in particularly advantageous fashion, for the folding apparatus to be arranged in the direct paper path of a device. With the apparatus according to the invention it is thus advantageously possible, on the same paper path, both to transport a sheet without folding and to perform a Z-fold, without thereby requiring bulky diverters and additional paper paths or needing to change the transport direction of the sheet.

The pressure roller unit according to the invention of the folding apparatus advantageously has a bearing shaft with rectangular cross section, on which bearing bushings for independently rotatable mounting of the rollers of the pressure roller arrangement are arranged, the bearing bushings being positively joined to the bearing shaft.

In an advantageous embodiment of the invention, the bearing bushings are equipped at one end with a shoulder which defines the axial position of a slid-on roller and at the same time ensures definition of the mutual positions of the bearing bushings and rollers arranged next to one another, in such a fashion that the rollers are mounted to rotate freely without influencing one another.

In a further embodiment of the invention, the bearing bushings are equipped at the ends with a recess which is concentric about the eccentric offset of the bearing region and into which the running surface of an adjacent bearing bushing, rotated through 180 degrees, engages, so that the mutually rotated arrangement of the bearing bushings and thus their functionally correct eccentric offset by an amount x is guaranteed.

Further features and advantages are evident from the description of an exemplified embodiment of the invention that is depicted in the drawings, and from the subclaims.

BRIEF DESCRIPTION OF THE DRAWINGS

FIG. 4 shows the apparatus according to FIG. 3 in a different oblique view, with the pressure roller unit swung in;

DETAILED DESCRIPTION OF THE INVENTION

Figure 1:
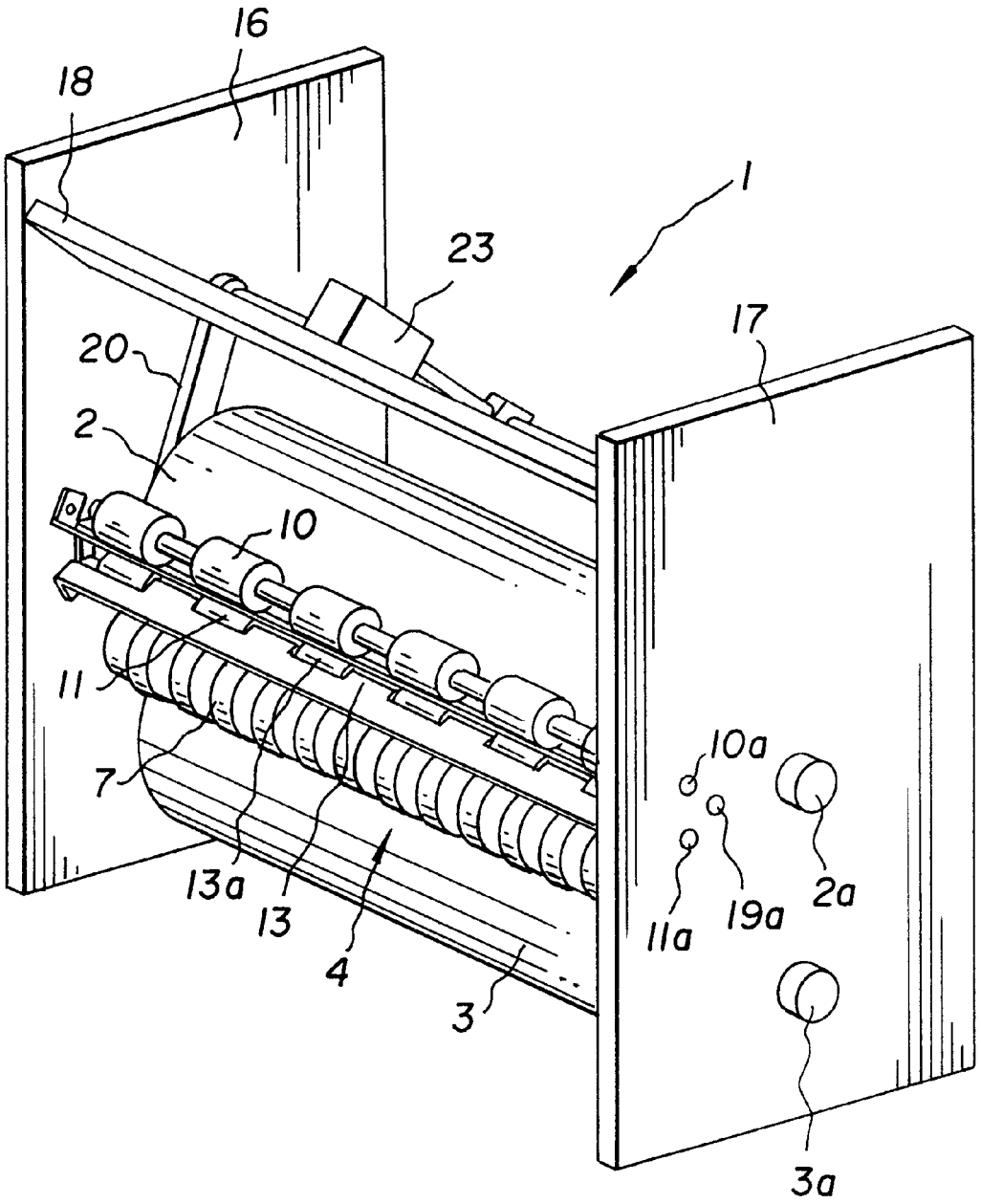
FIG. 1 shows the apparatus in an oblique view.

The folding apparatus according to the invention is, for example, part of a finisher (not depicted) into which copied sheets output from a copier (not depicted) of known type are fed, in order to be given a Z-fold or to be transported on without folding. All that is depicted of the finisher, with which copied sheets can in known fashion be collected in stacked fashion in a collection station and then stapled in sets or transported unstapled into a delivery station, are those components of a folding apparatus I required for an understanding of the invention.

Folding apparatus 1 has two panels 16 and 17, joined together by means of crossmembers 18 (only one crossmember depicted), on which two folding rolls 2 and 3 and two transport rollers 10 and 11 of known type, as well as a pivot apparatus for a pressure roller unit 4 yet to be described, are mounted rotatably and pivotedly, respectively.

Folding rolls 2, 3 and transport rollers 10, 11 of known type are mounted in stationary and rotatable fashion onto panels 16 and 17 by means of bearing pins 2*a*, 3*a* and 10*a*, 11*a*, respectively, and are each driven via an electric motor (not depicted) of conventional type, for example a stepping motor.

Folding rolls 2, 3 are both driven in opposite directions via a common drive train of known type (not depicted), and rest in nonpositive contact against one another.

Only one of transport rollers 10 or 11 of transport roller pair 10, 11 is driven, while the other transport roller 11 or 10 is entrained frictionally. Transport rollers 10, 11 are each equipped, in a known manner evident in particular from FIG. 1, with roller regions arranged at a distance from one another which are located opposite one another and rest nonpositively against one another.

Figure 2:
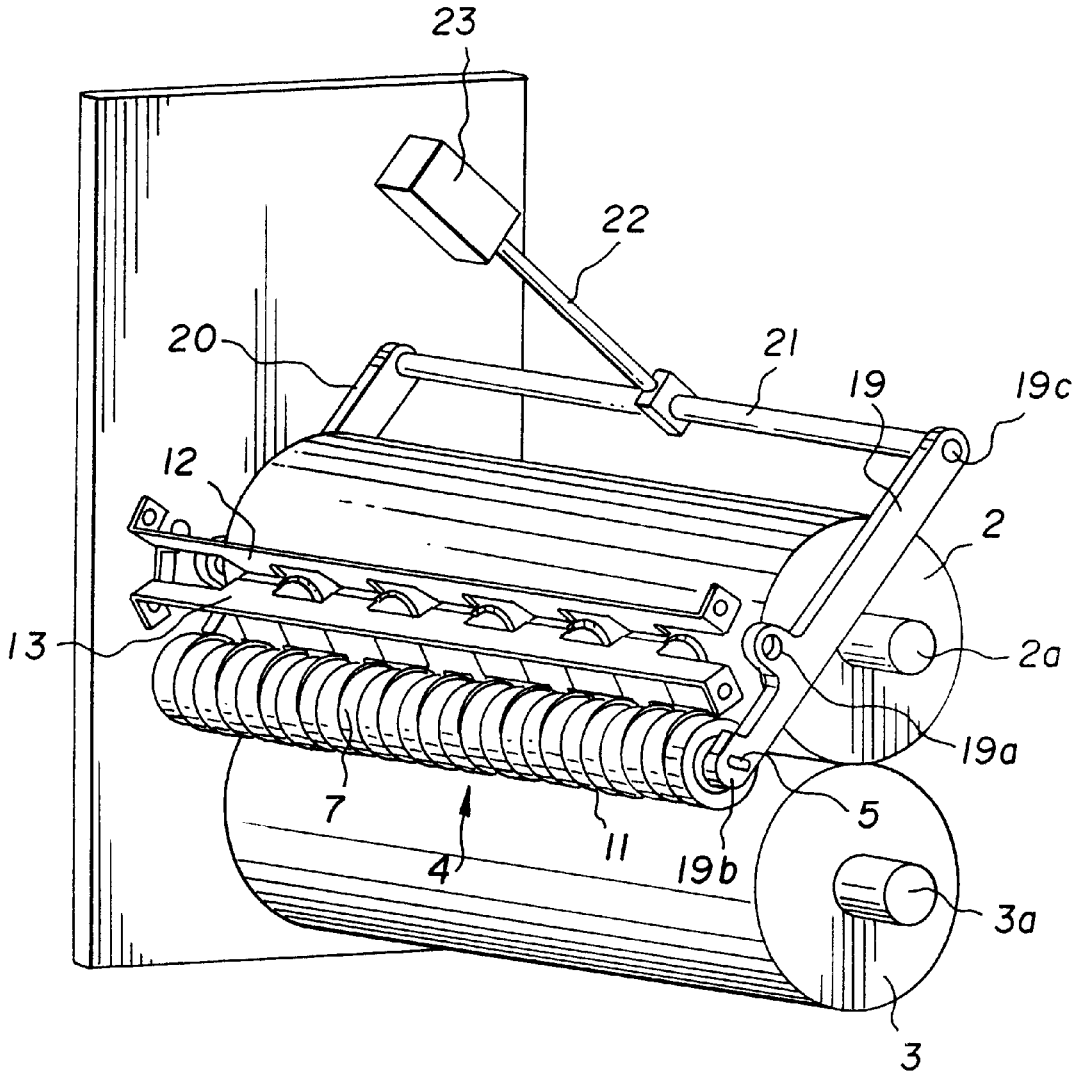
FIG. 2 shows the apparatus according to FIG. 1, without transport rollers and with one front panel omitted.
Figure 4:
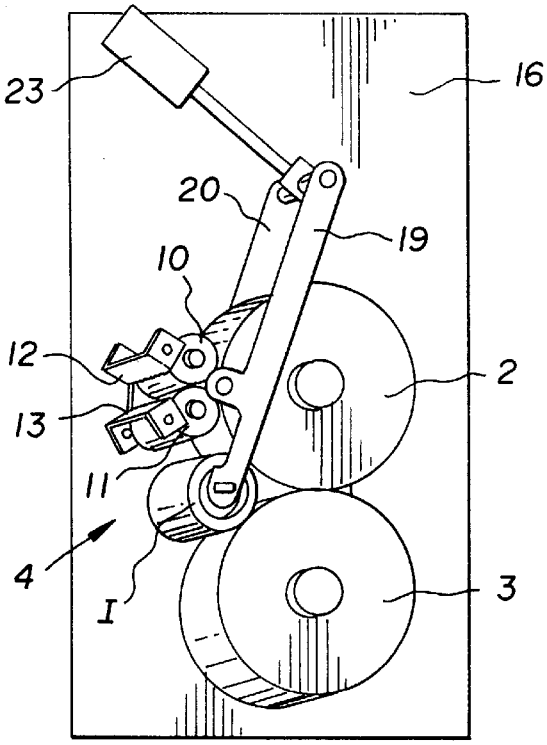

As shown in particular by FIGS. 1, 2, and 4, guide elements 12 and 13 which extend over the entire length of transport rollers 10 and 11 and are fastened at their respective ends to panels 16 and 17 are associated with transport rollers 10 and 11. It is apparent from FIG. 1 that guide elements 12 and 13 are equipped with cutouts 13*a* through which the individual roller regions of transport rollers 10 and 11 can emerge. As is evident in particular from FIGS. 8–20, the guide elements are arranged so that they constitute a guide channel for a sheet 24 entering in arrow direction "A" between transport rollers 10 and 11, which guides the sheet to the roller gap between folding roll 2 and pressure roller unit 4.

Associated with folding rolls 2 and 3 is pressure roller unit 4, which is arranged between two pivot arms 19 and 20 that are mounted in stationary fashion pivotedly about bearings 19*a* on both panels 16 and 17. Pivot arms 19 and 20 are joined together, at their lower end 19*b* by means of a bearing shaft 5 of pressure roller unit 4, and at their upper end 19*c* by a rod 21, into a rigid assembly that can be pivoted via an actuator 22 engaging on rod 21 by an electromagnet 23 arranged in stationary fashion.

A sensor such as a photoelectric barrier 15 of known type (see FIGS. 8–20) which scans the transport path of a sheet 24 is arranged before transport rollers 10, 11 in the infeed path of a sheet 24.

A further sensor such as a photoelectric barrier 14 scans the transport path of a sheet 24 emerging in arrow direction "B" from folding rolls 2, 3.

Folding apparatus 1 is controlled by a microprocessor-controlled device (not depicted) of known type, by means of signals emitted by photoelectric barriers 14 and 15.

Pressure roller 4, which consists of bearing shaft 5 with bearing bushings 6 slid thereonto and rollers 7 mounted thereon, is described below:

Bearing shaft 5 has a substantially rectangular cross section and is fastened onto pivot arms 19 and 20. A plurality of identical bearing bushings 6, which are joined positively and displaceably to bearing shaft 5 by appropriate shaping of their bearing region 6*a*, are arranged on bearing shaft 5. Bearing bushings 6 have a cylindrical running surface 6*b* on which identical rollers 7, configured with rotational symmetry and equipped with a bore 7*a*, are mounted so as to rotate freely.

Arranged at one end of each bearing bushing 6 is a shoulder 6*c* which has a greater diameter than running surface 6*b*. Shoulder 6*c* serves, with a first side surface 6f facing running surface 6*b*, to define the axial position of roller 7, while a second side surface 6*d*, facing an adjacent bearing bushing 6, of shoulder 6*c* defines the axial position of roller 7 mounted on the adjacent running surface 6*b*.

Figure 7:
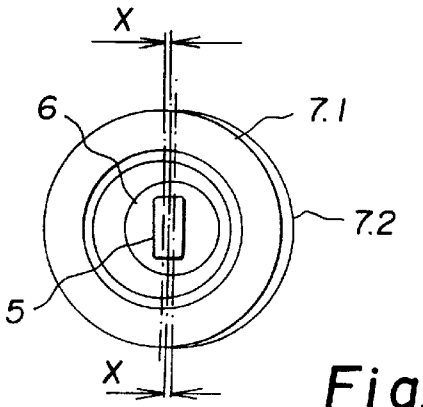
FIG. 7 shows a side view of the drive roller unit according to FIG. 6, and FIGS. 8 to 20 show the operating sequence of the apparatus according to FIG. 1, in a simplified depiction and in side view.
Figure 10:
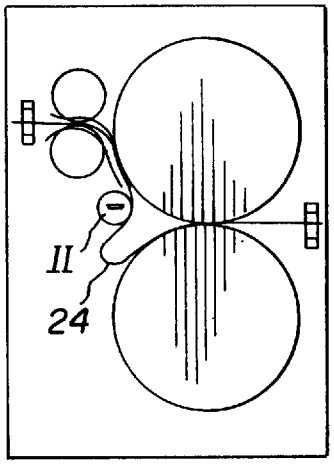
Figure 9:
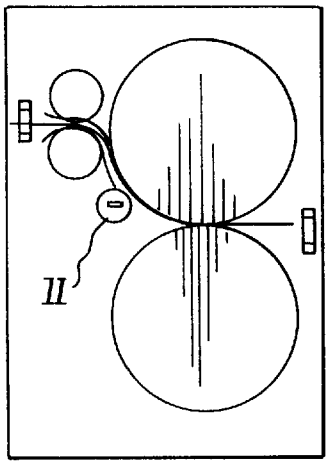

Bearing region 6*a* of bearing bushing 6 is offset eccentrically from the center axis of running surface 6*b* by an amount "x" of, for example, 0.7 mm (see FIG. 7).

A circular depression 6*e* is arranged on the second side surface 6*d* of bearing bushing 6 which faces running surface 6*b* of an adjacent bearing bushing 6 slid onto bearing shaft 5. Depression 6*e* is offset once again by the same amount "x" with respect to the above-described eccentric offset of bearing region 6*a*, so that depression 6*e* is eccentrically offset by twice the amount "x" from running surface 6*b* of bearing bushing 6. This ensures that bearing bushings 6 can be slid onto bearing shaft 5 only in a functionally correct orientation with respect to one another, as will be explained later in detail.

Rollers 7 have at their two opposite ends identical, symmetrical recesses 7*c* which, in the assembled state, overlap shoulder 6*c* of bearing bushing 6 although the ends of adjacent rollers 7 do not touch. End surfaces 7*d* of recesses 7*c* of rollers 7 are arranged so that they allow free rotation of rollers 7 on running surfaces 6*b* and between the first and second side surfaces 6*d* and 6*f* of adjacent bearing bushings 6.

Figure 6:
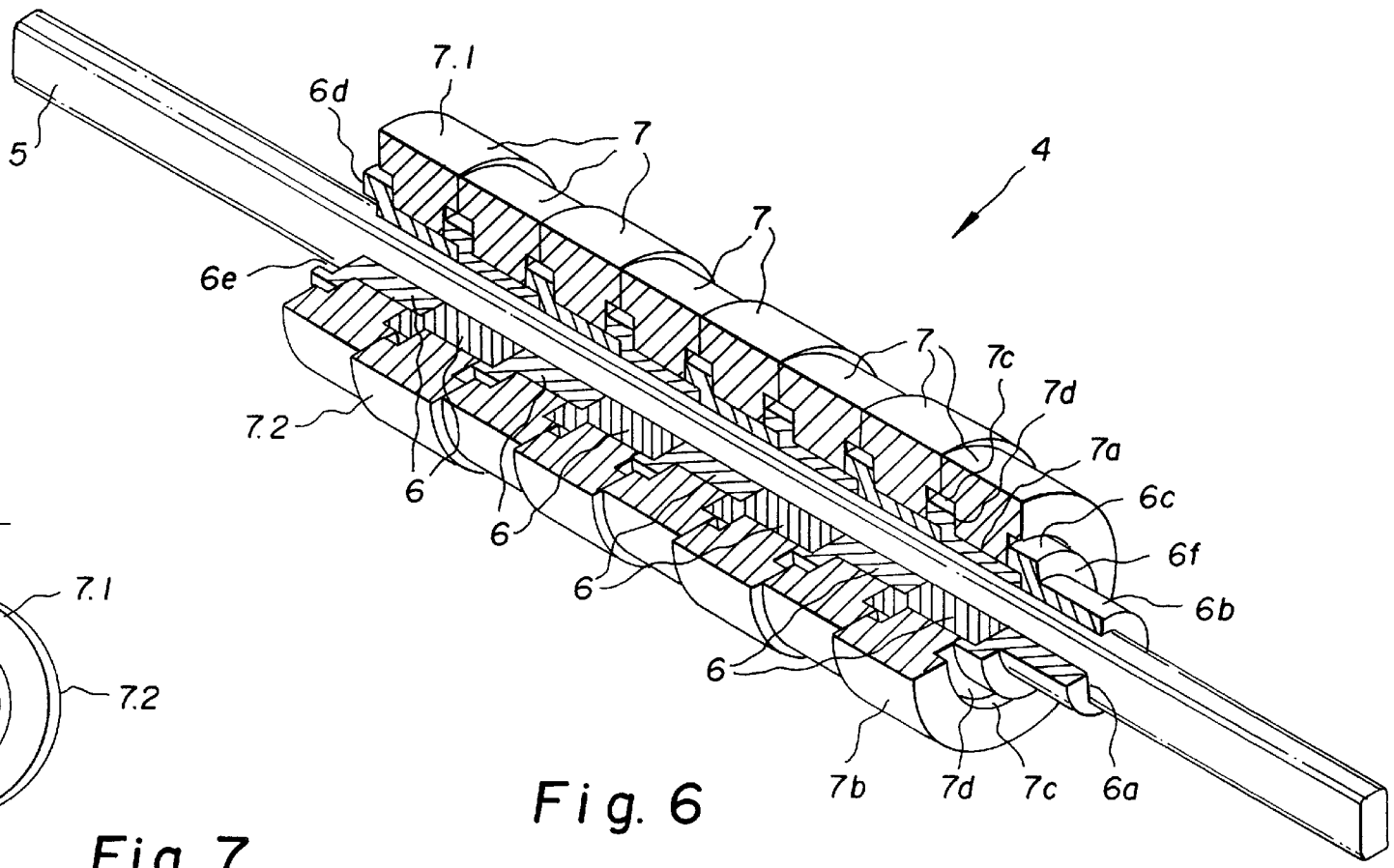
FIG. 6 shows an oblique view of a pressure roller unit according to FIG. 1, partly in section.

Transport roller unit 4 is assembled as follows:

Referring to FIG. 6, a bearing bushing 6 is slid, shoulder 6*c* first, from right to left onto bearing shaft 5 which is not yet joined to pivot arms 19 and 20. Then a roller 7 is placed from the same direction onto running surface 6 of bearing bushing 6. The next bearing bushing 6 is also slid onto bearing shaft 5, shoulder 6*c* first but rotated 180 degrees about its longitudinal axis, until it comes to rest against bearing bushing 6 that was slid on first. A roller 7, whose outside diameter is now offset by an amount "x times 2" with respect to roller 7 placed on first, is then placed onto running surface 6*b* of said bearing bushing 6. This assembly operation is continued, alternating as described, until the desired length of pressure roller unit 4 is achieved. To conclude, one further bearing bushing 6, once again rotated 180 degrees with respect to its predecessor, is slid onto bearing shaft 5.

Two roller groups 7.1 and 7.2 are now present on the completely assembled pressure roller unit 4, each with a number of rollers 7 that, as is evident particularly from FIG. 6, are arranged (only one roller of the two roller groups being shown in order to simplify the depiction) so that each roller 7 of the one roller group 7.1 is arranged with an eccentric offset of "x times 2" with respect to the adjacent roller 7 of the other roller group 7.2.

Functionally correct assembly of the mutually offset rollers 7 is facilitated and ensured by the fact that depression 6*e* on shoulder 6*c* of each bearing bushing 6 is arranged, as already described, at an offset of twice the amount "x" with respect to running surface 6*b* of bearing bushing 6. As a result, two adjacent bearing bushings 6 can be installed in functionally correct contact against one another only in the position offset 180 degrees from one another.

Pivot arms 19 and 20, which define the axial position of bearing bushings 6 and roller 7, are then placed onto the ends of bearing shaft 5 of the completely assembled pressure roller unit 4.

Bearing shaft 5 is produced from steel, while bearing bushings 6 and rollers 7 are made of a suitable plastic and can be manufactured using an injection method of known type. Rollers 7 can also, in a known manner (not depicted), consist of a plastic core suitable for sliding purposes, on which a peripheral surface of plastic, rubber, or the like, suitable for transport purposes, is applied by injection or fastened.

Bearing shaft 5 is arranged on pivot arms 19 and 20, secured against rotation, in such a way that the longest extension of the rectangular cross section of bearing shaft 5 runs in the direction in which pressure roller unit 4 is pressed on. This results in the greatest possible flexural strength for bearing shaft 5 and thus for the entire pressure roller unit 4.

Figure 5:
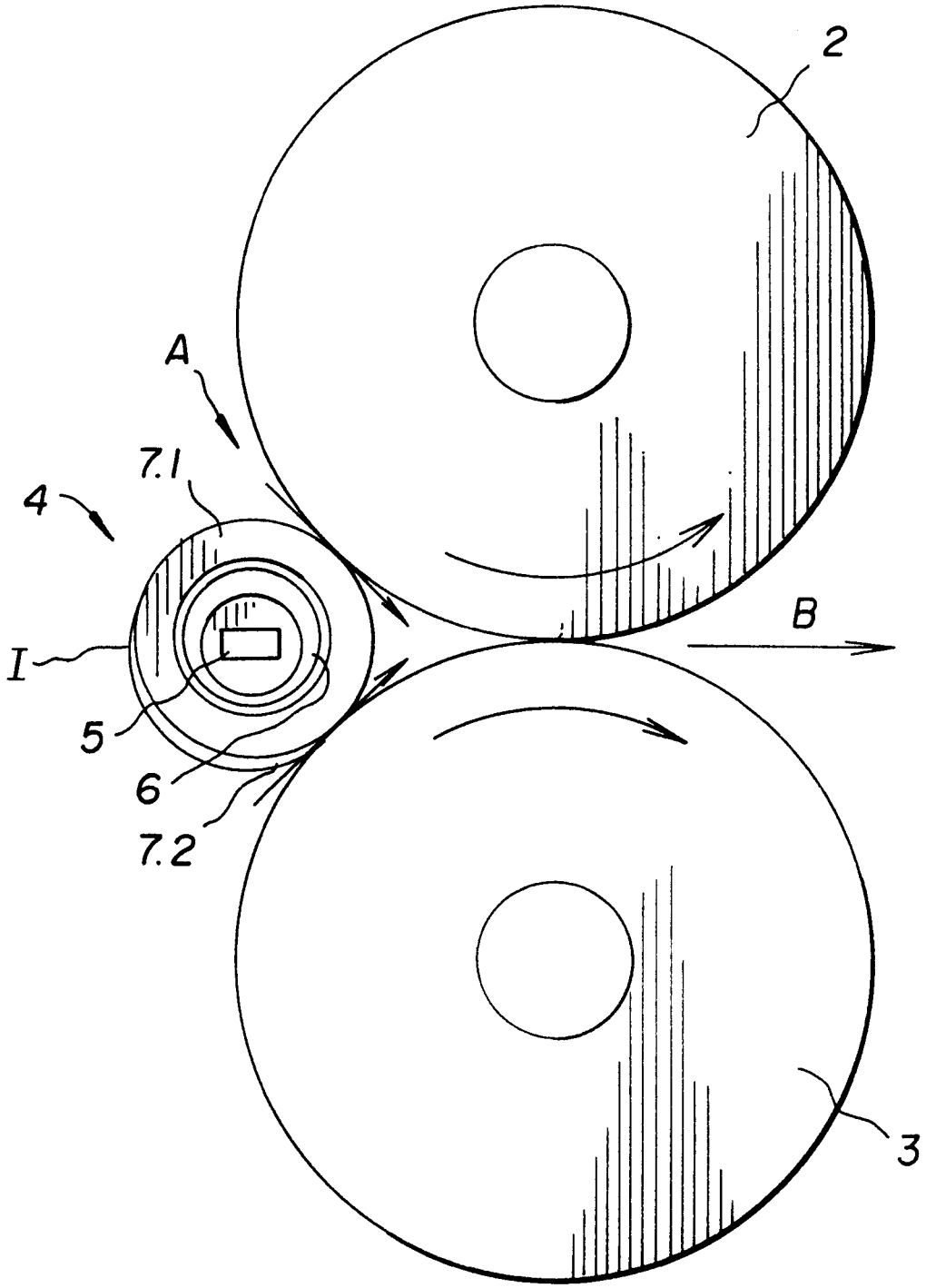
FIG. 5 shows a partial view of the apparatus according to FIG. 1.

Once pressure roller unit 4 is installed, according to FIG. 5 rollers 7 of the one roller group 7.1 of pressure roller unit 4 rest nonpositively against folding roll 2, while rollers 7 of the other roller group 7.2 of pressure roller unit 4 rest nonpositively against folding roll 3. Driven folding rolls 2, 3 drive the two roller groups 7.1 and 7.2 of pressure roller unit 4, the rollers 7 of which are mounted so as to rotate independently, in opposite rotation directions.

Figure 8:
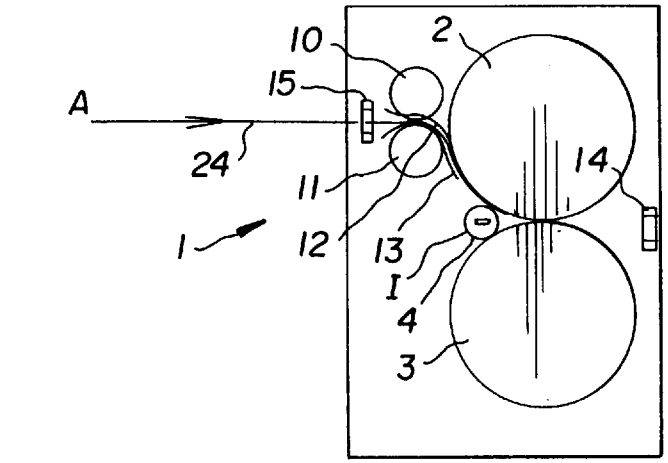
Figure 14:
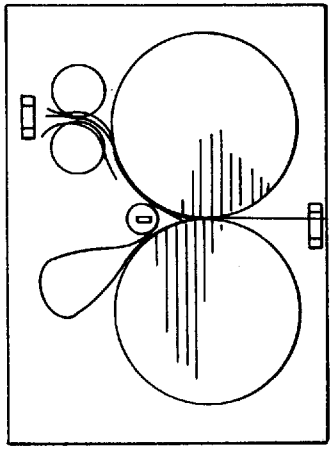

The operation of the folding apparatus will be described below with reference to the operating sequence depicted in FIG. 8 to 20:

According to FIG. 8, the apparatus assumes a starting position in which pressure roller unit 4 is in a first position I in spring-loaded contact against folding rolls 2, 3. Transport rolls 10, 11 and folding rolls 2, 3 are driven at the same transport speed $v_2$.

Figure 3:
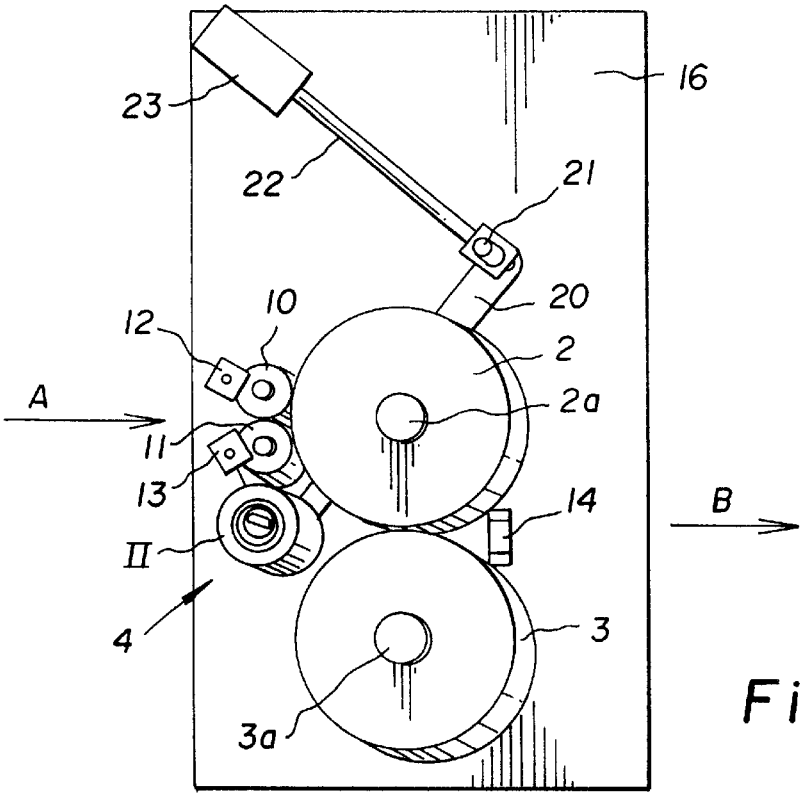
FIG. 3 shows the apparatus according to FIG. 1 in a different oblique view, with the front panel omitted and the pressure roller unit lifted away.

A sheet 24 transported in arrow direction "A" passes by photoelectric barrier 15 and triggers a first control signal by which the starting time of the folding operation sequence is defined. Sheet 24 enters the guide channel constituted by guide elements 12, 13, and is transported by transport rollers 10, 11 through the guide channel to the roller gap between folding roll 2 and roller 7 of pressure roller unit 4 in contact therewith, which transport sheet 24 into the roller gap of folding rolls 2, 3. Folding rolls 2, 3 then, at a time t1, transport sheet 24 further in arrow direction "B". At a time $t_2$, electromagnet 23 is activated and, via actuator 22, moves pivot arms 19, 20 and pivots pressure roller unit 4 into position II depicted in FIGS. 2, 3, and 9, in which the latter assumes a position lifted away from folding rolls 2, 3.

Sheet 24 continues to be transported by folding rolls 2 and 3. When its front edge passes by photoelectric barrier 14, a second control signal is triggered which, at a time $t_3$, reduces the drive system of folding rolls 2 and 3 to a lower transport speed $v_1$. In this operating sequence depicted in FIGS. 10 and 11, sheet 24, which is transported in its front region (viewed in the transport direction) at the slower transport speed $v_1$ but in its rear region continues to be transported at the higher transport speed $V_2$ by transport rollers 10 and 11, is bulged out so as to form an increasingly large arc.

Figure 12:
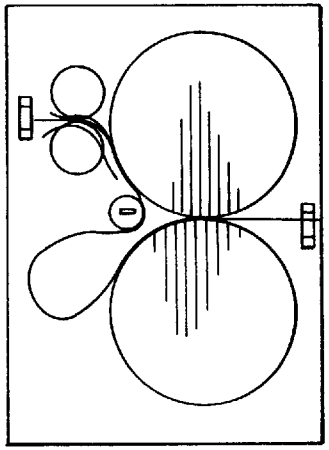
Figure 11:
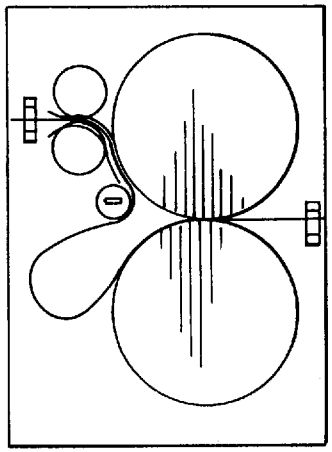
Figure 15:
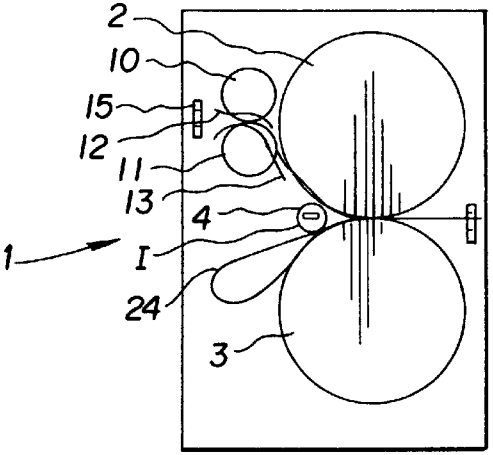

The drive system of folding rolls 2 and 3 is accelerated back to transport speed $v_2$, until at a time $t_4$ the transport speeds of folding rolls 2, 3 and of transport rolls 10, 11 are again identical and sheet 24 has been bulged out to the required arc length (see FIG. 12).

Figure 13:
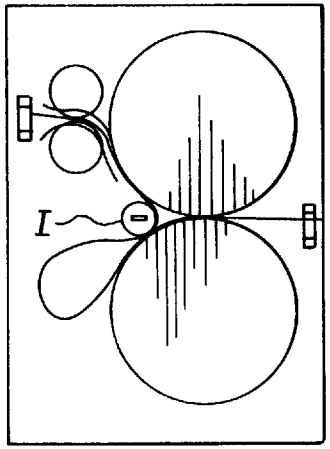

When the transported sheet 24 clears photoelectric barrier 15 with its rear edge at a time $t_5$, a third control signal is generated, by means of which electromagnet 23, via pivot arms 19 and 20, once again lays pressure roller 4 in spring-loaded fashion against folding rolls 2 and 3 at a time $t_6$ (see FIG. 13).

Sheet 24 is now, according to FIGS. 4, 5, and 13–15, pressed against folding rolls 2 and 3 and transported both by rollers 7 of roller group 7.1 (see FIGS. 4, 6, and 7) and by rollers 7 of roller group 7.2 of pressure roller unit 4, so that the two sheet regions grasped by roller groups 7.1 and 7.2 are folded toward one another. When these two sheet regions are fed in between folding rolls 2 and 3 as transport proceeds, the first fold is formed at a time $t_7$.

Figure 16:
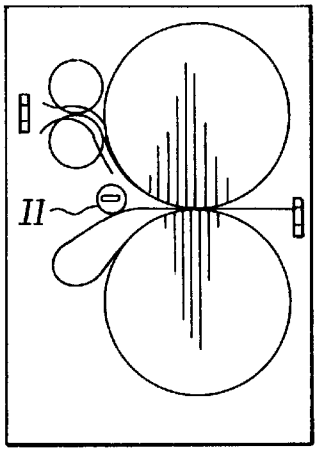

Pressure roller unit 4 is then, at a time $t_8$, pivoted away from folding rolls 2 and 3 again by electromagnet 23, and transferred into the lifted-away position II according to FIG. 16.

Figure 17:
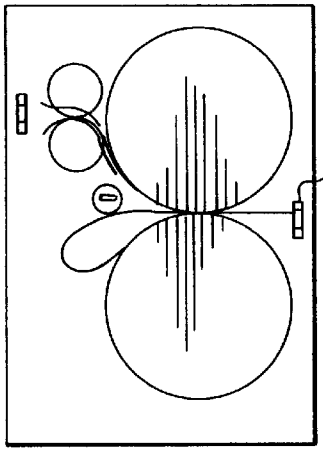
Figure 18:
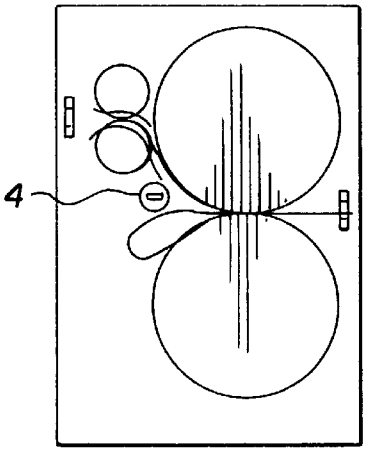
Figure 19:
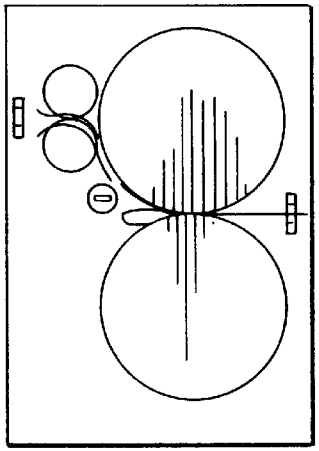

Upon continued transport of sheet 24, which always occurs uninterruptedly in the same transport direction during the entire folding operation, the arc region of the sheet is folded together as depicted in FIGS. 17–19, until at a time $t_9$ the second fold is formed between folding rolls 2 and 3.

Figure 20:
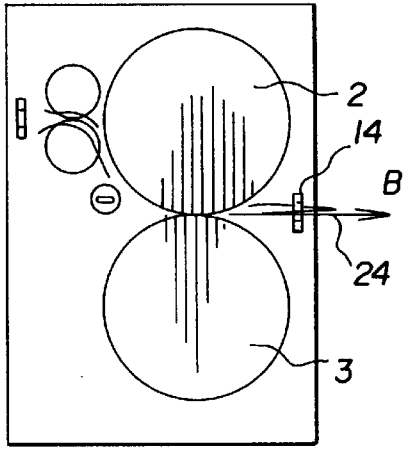

The completed folded sheet 24 is then delivered in arrow direction "B" as depicted in FIG. 20. When the end of the sheet clears photoelectric barrier 14, the fourth control signal triggered thereby causes pressure roller unit 4 to pivot into position I according to FIG. 8, in spring-loaded contact against folding rolls 2, 3.

The sequence over time—$t_1$ to $t_9$—and the transport speeds—$v_1$ and $v_2$—are adjusted to one another under microprocessor control in such a way that the required location of the folds is achieved by means of the functional sequence described.

Proceeding from the starting position depicted in FIGS. 4, 5, and 8, either another folding operation can occur in the manner described, or sheet transport can occur without folding. All that is necessary for this is to switch the microprocessor control system to the desired operating mode (not depicted) by entry of a corresponding command (by having the user press a button, or by preselection of an automatically executed program).

If transport alone without folding is to occur, the apparatus then remains in the starting position according to FIGS. 4, 5, and 8, and the transport speed is simply adjusted to a suitable higher speed. Sheet 24 being fed in arrow direction "A" travels, on the same transport path as described above, through transport rollers 10, 11 and the guide channel formed between guide elements 12, 13, into the roller gap between roller group 7.1 of the pressure roller unit 4 and folding roll 2, and from there via folding rolls 2, 3 out of the apparatus in arrow direction "B".

The sheets emerging from the apparatus, folded or unfolded, pass into a delivery station (not depicted), as already mentioned.

The invention has been described in detail with particular reference to certain preferred embodiments thereof, but it will be understood that variations and modifications can be effected within the spirit and scope of the invention.

Parts List

1. Apparatus
2. Folding roll
2*a*. Bearing pin
3. Folding roll
3*a*. Bearing pin
4. Pressure roller unit
5. Bearing shaft
6. Bearing bushings
6*a*. Bearing region
6*b*. Running surface
6*c*. Shoulder
6*d*. Second side surface
6*e*. Depression
6*f*. Side surface
7. Rollers
7.1 Roller group
7.2 Roller group
7*a*. Bore
7*c*. Recesses
7*d*. End surfaces
10. Transport roller
10*a*. Bearing pin
11. Transport roller
11*a*. Bearing pin
12. Guide element
13. Guide element
13*a*. Cutouts
14. Photoelectric barrier
15. Photoelectric barrier
16. Panel
17. Panel
18. Crossmembers
19. Pivot arm
19*a*. Bearings
19*b*. Lower end
19*c*. Upper end
20. Pivot arm
21. Rod
22. Actuator
23. Electromagnet
24. Sheet

What is claimed is:

1. Apparatus for Z-folding sheets, which has a folding roll pair driven in opposite directions and a transport roller pair for delivering the sheets to the folding rolls of the folding roll pair, said Z-folding apparatus comprising:

associated with the folding rolls of the folding roll pair, a pressure roller unit positioned, with respect to a transport path of a sheet, between the transport rollers and the folding rolls that in a first position (I) rests against both folding rolls simultaneously and for moving into a second position (II) lifted away from the folding rolls;

a sensor arranged in the transport path of the sheet is associated with the transport roller pair;

a sensor arranged in the transport path of the sheet is associated with the folding rolls;

have transport speed which of the folding rolls is changeable;

the pressure roller unit has a plurality of rollers, arranged next to one another and each independently rotatably mounted;

the pressure roller unit has a first and a second roller group with rollers, of which the rollers of the first roller group are mounted eccentrically, to more positively grip the sheet by a certain amount (x) with respect to the longitudinal axis of the pressure roller unit, and the rollers of the second roller group are mounted eccentrically with respect to the longitudinal axis of the pressure roller unit by said certain amount in the opposite direction from the rollers of the first roller group; and the rollers of said pressure roller unit are arranged in such a way that of each two of said rollers arranged next to one another, one is associated with the first roller group and one with the second; and with the pressure roller unit in the first position (I), the rollers of the first roller group are in nonpositive contact against the one folding roll, and the rollers of the second roller group against the other folding roll.

2. The Z-folding apparatus as defined in claim 1, wherein the pressure roller unit has a bearing shaft fastened to a pivotable carrier and secured against rotation;

a plurality of bearing bushings are arranged on the bearing shaft and positioned next to one another in its longitudinal direction;

the bearing bushings have a bearing region which is mounted to the bearing shaft and secures against radial rotation, as well as a cylindrical running surface;

the bearing region of the bearing bushings that is mounted to the bearing shaft is arranged eccentrically with respect to the running surface of the bearing bushings;

said rollers of the first roller group and the second roller group configured in rotationally symmetrical fashion on the running surfaces of the bearing bushings are mounted in independently rotatable fashion; and the bearing bushings are arranged, with respect to their eccentric configuration, alternatingly rotated 180 degrees with respect to one another on the bearing shaft in such a way that of each of said two rollers arranged next to one another, the one of said two roller is laid with its circumferential surface not engaged against the one folding roll, and the other roller can be laid with its circumferential surface not engaged against the other folding roll.

3. The Z-folding apparatus as defined in claim 2, wherein the bearing bushings have at one end a shoulder that is greater in diameter than the diameter of the running surfaces; the shoulder defines, with its side surface facing the running surface, the axial position of the rollers arranged on the running surfaces; and the shoulder defines, with its side surface associated with the adjacent bearing bushing, the axial position of the roller arranged on the running surface of the respective adjacent bearing bushing.

4. The Z-folding apparatus as defined in claim 3, wherein the side surface, associated with the adjacent roller, of the bearing bushing has a circular depression that is arranged eccentrically by twice the offset (x) from the running surface of the bearing bushing; and the respective adjacent bearing bushing, arranged rotated 180 degrees about its longitudinal axis, engages into the depression.

5. The Z-folding apparatus as defined in claim 4, wherein the rollers have at their two end surfaces recesses which engage into the shoulder of the respective adjacent bearing bushing in such a way that the rollers can be installed directly next to one another so that the recesses are arranged symmetrically with respect to the roller.

6. The Z-folding apparatus as defined in claim 5, wherein the bearing shaft has a substantially rectangular cross section; and the bearing shaft is arranged with respect to the associated folding rolls in such a way that the longest extension of the rectangular cross section runs in the direction in which the pressure roller unit is pressed on.

7. The Z-folding apparatus as defined claim 6, wherein the bearing region of the bearing bushings has a rectangular shape mounted on to the cross section of the bearing shaft.

8. The Z-folding apparatus as defined in claim 7, wherein the folding rolls and the associated rollers of the pressure roller unit are arranged in the same transport path of a device through which sheets not being folded also pass.

9. The Z-folding apparatus as defined in claim 8, wherein the carrier of the pressure roller unit is pivotable in electromagnetically actuated fashion.

10. The Z-folding apparatus as defined in claim 9, wherein guide elements which constitute a transport channel to the folding rolls are associated with the transport elements.

* * * * *

UNITED STATES PATENT AND TRADEMARK OFFICE

CERTIFICATE OF CORRECTION

PATENT NO. : 5,980,444
DATED : November 9, 1999
INVENTOR(S) : Andreas Dickhoff

It is certified that error appears in the above-identified patent and that said Letters Patent is hereby corrected as shown below:

Column 8,
Lines 17-18, "have transport speed which of the folding rolls is changeable;" should read -- the folding rolls have a transport speed which is changeable; --
Line 61, "roller", should read -- rollers --

Signed and Sealed this

Twenty-eighth Day of January, 2003

JAMES E. ROGAN
*Director of the United States Patent and Trademark Office*